United States Patent [19]

Mowli et al.

[11] 4,117,934

[45] Oct. 3, 1978

[54] RECLOSABLE BAG

[76] Inventors: John C. Mowli, 2032 W. Jarvis, Chicago, Ill. 60645; Harry Bala, 2259 N. Kedzie, Chicago, Ill. 60647

[21] Appl. No.: 770,603

[22] Filed: Feb. 22, 1977

[51] Int. Cl.[2] ..... B65D 27/34; B65D 33/30

[52] U.S. Cl. ..... 206/610; 229/65

[58] Field of Search ..... 229/63, 65, 66, 78 A, 229/78 B; 206/610, 611, 612, 618

[56] References Cited

U.S. PATENT DOCUMENTS

| | | | |
|---|---|---|---|
| 3,093,295 | 6/1963 | Kugler | 229/63 |
| 3,150,813 | 9/1964 | Wellman | 229/65 |
| 3,327,926 | 6/1967 | Kreamer | 229/65 |
| 3,542,190 | 11/1970 | Keller | 229/65 X |
| 3,545,668 | 12/1970 | Hultberg | 229/65 |
| 3,889,871 | 6/1975 | White | 229/65 |

FOREIGN PATENT DOCUMENTS

| | | | |
|---|---|---|---|
| 1,256,236 | 2/1961 | France | 229/78 B |
| 2,429 of | 1867 | United Kingdom | 229/65 |
| 936,692 | 9/1963 | United Kingdom | 229/66 |

*Primary Examiner*—Stephen Marcus

*Attorney, Agent, or Firm*—George H. Gerstman

[57] ABSTRACT

The back wall of a plastic bag formed of heat sealable film-type material is folded over a stiffener strip and is sealed to itself. The stiffener strip is intermediate at least two plies formed from the overfolded back wall and a bag mouth portion is located intermediate the stiffener strip and the bottom of the bag.

1 Claim, 16 Drawing Figures

FIG. 1
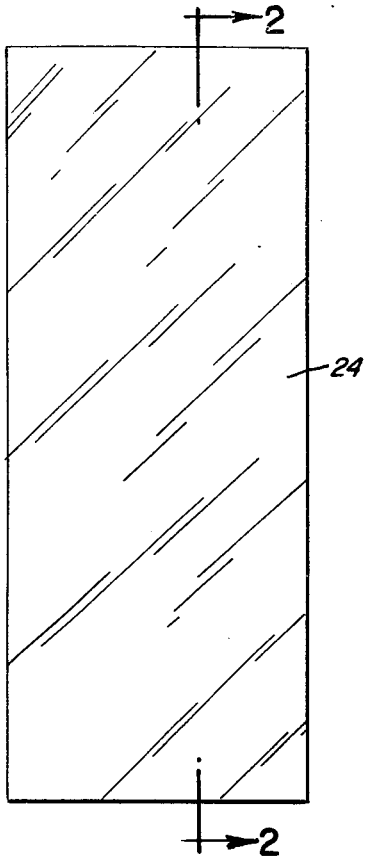
FIG. 2
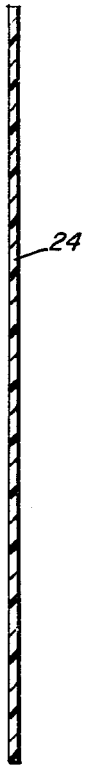
FIG. 3
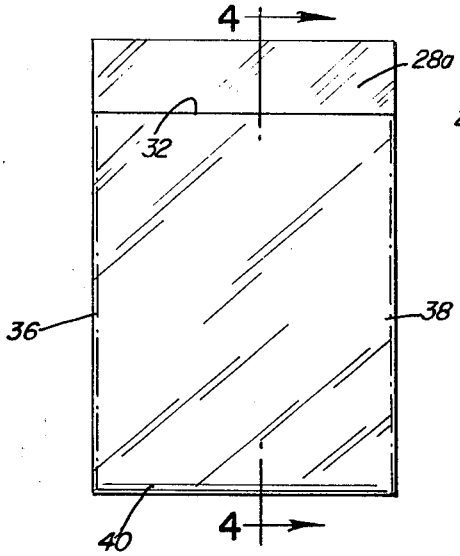
FIG. 4
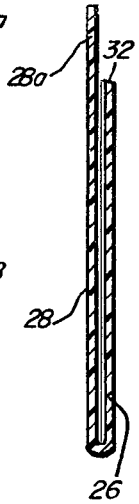
FIG. 5
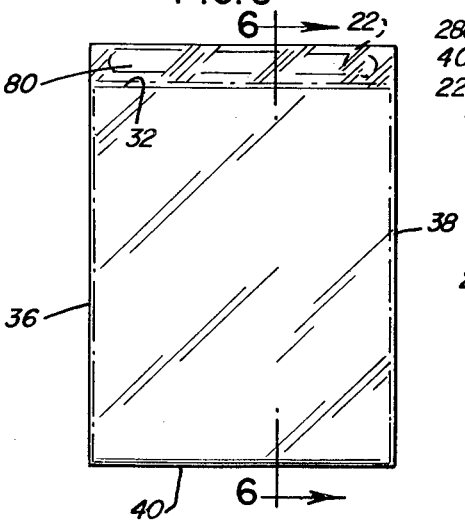
FIG. 6
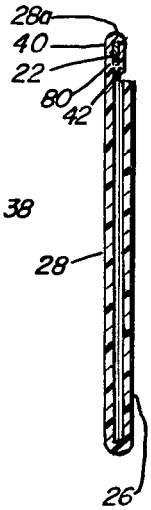
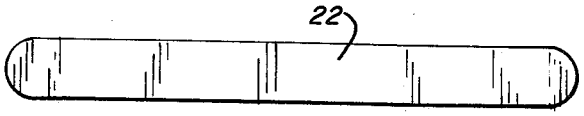
FIG. 7
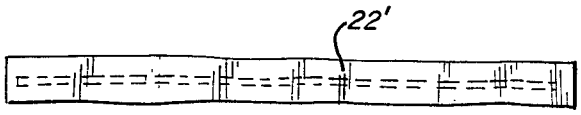
FIG. 8

FIG. 10
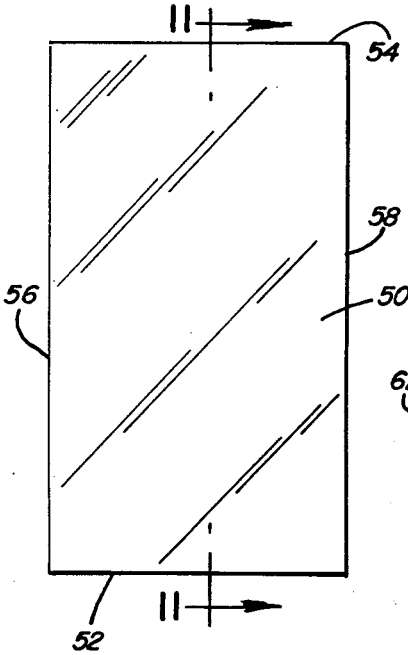
FIG. 11
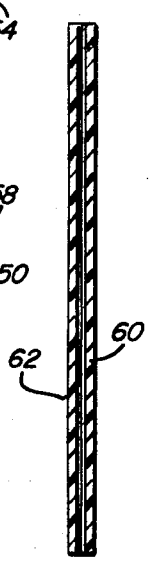
FIG. 12
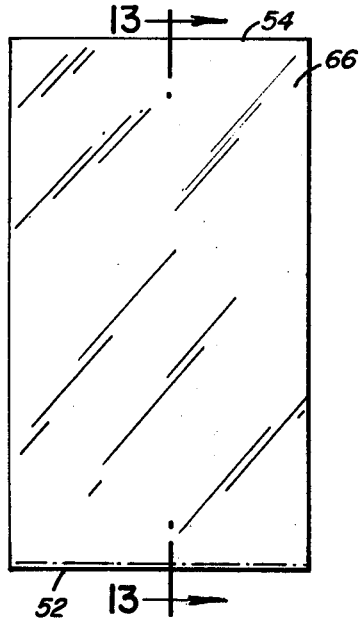
FIG. 13
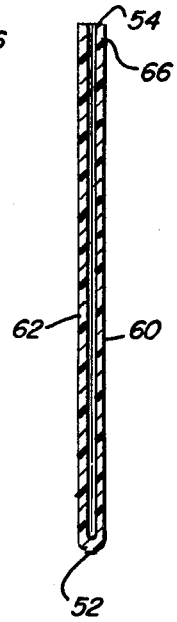
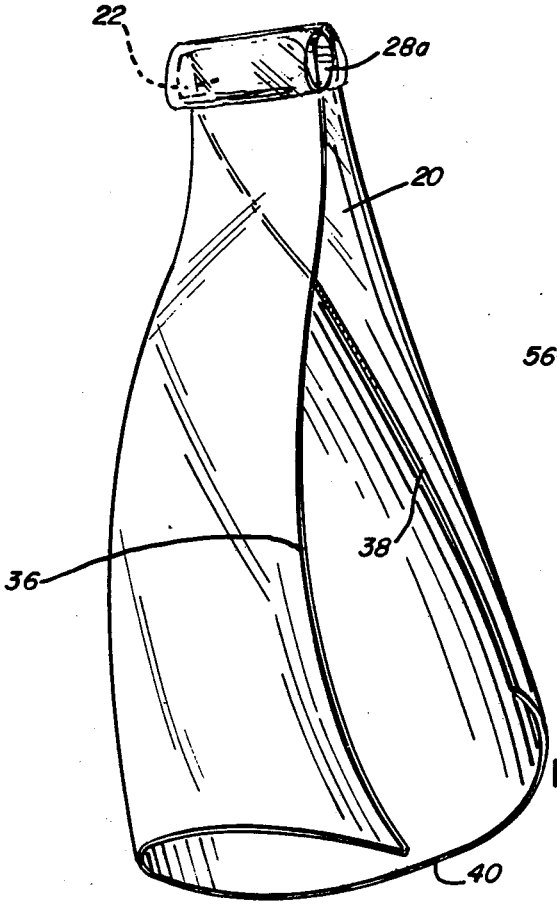
FIG. 9
FIG. 14
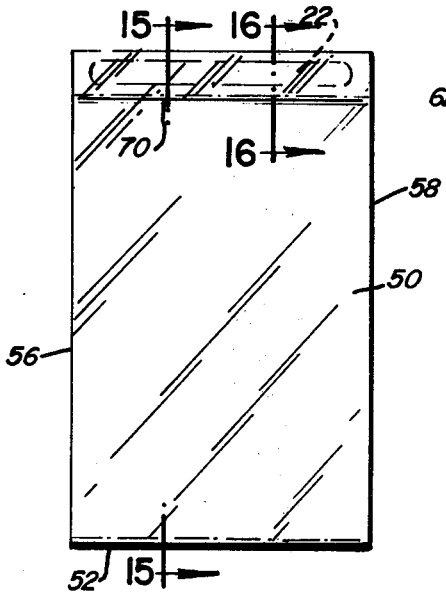
FIG. 15
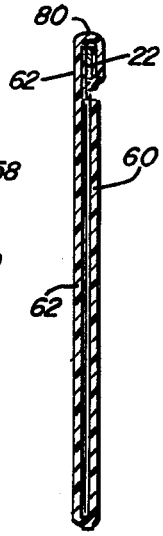
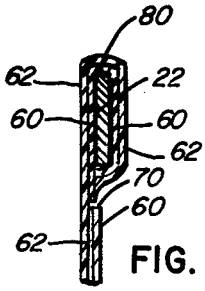
FIG. 16

RECLOSABLE BAG

BACKGROUND OF THE INVENTION

This invention relates to a novel reclosable container which is inexpensive to manufacture and easy to use.

An increasing number of articles are packaged in plastic bags. In addition, rolls of plastic bags are presently sold for consumer use in packaging household items or the like. It is often desirable to have the ability to remove at least part of the bag's contents and reclose the bag thereafter. However, various disadvantages have been found with prior art reclosable bags.

For example, one type of reclosable bag is disclosed in Ruda U.S. Pat. No. 3,759,438. In the Ruda construction, a stiffener is located inside the mouth of the bag, which provides a construction that is relatively difficult to manufacture. Additionally, Ruda's construction requires heat sealing of the stiffener prior to heat sealing the sides of the bag. It would be advantageous to have the ability to heat seal the stiffener either before, after or at the time the sides of the bag are sealed.

The prior art patent to White, U.S. Pat. No. 3,889,871, discloses another type of reclosable bag in which a separate tape is required to connect the stiffener to the bag. The requirement of a separate fastening means is deleterious to optimum manufacture.

Another type of reclosable bag construction is disclosed in Hoeppner, et al. U.S. Pat. No. 2,620,842, in which a flap overlies the front wall and mouth of the bag, to provide a handle and closure means. However, the security of the Hoeppner, et al. bag is questionable because there is no tie or stiffener to provide a repeatable secure closure.

The prior art patents to Rivman, et al., U.S. Pat. No. 3,321,126 and Chesney U.S. Pat. No. 587,928 show other prior art reclosable containers. In the Rivman, et al. patent, an external strip is required to be fastened over a wire stiffener. This has the disadvantage mentioned above in connection with White U.S. Pat. No. 3,889,871. Chesney discloses a paper container in which a stiffener is fastened below the mouth of the bag, so that the mouth of the bag becomes rolled about with the stiffener being bent to close the roll. In the Chesney construction, an external fastening strip is needed to fasten the stiffener to the bag.

It is an object of the present invention to provide a plastic bag that overcomes many of the disadvantages of prior art plastic bags. To this end, one of the objects of the present invention is to provide a bag which is efficient to manufacture and simple in operation.

Another object of the present invention is to provide a plastic bag using a stiffener member, with the stiffener member being located above the mouth of the bag for ease in operation.

A further object of the present invention is to provide a plastic bag construction in which the bag is heat sealed to contain a stiffener, with the heat seal being accomplished either before, after or during heat sealing the sides of the bag.

A still further object of the present invention is to provide a reclosable bag in which the stiffener is heat sealed to the bag using efficient production techniques.

Other objects and advantages of the present invention will become apparent as the description proceeds.

SUMMARY OF THE INVENTION

In accordance with the present invention, there is provided a plastic bag formed of heat sealable filmtype material and including a front wall, a back wall and closed bottom and side edges.

A stiffener strip is provided which is capable of being bent manually and retaining the bent shape. The back wall of the bag is folded over the stiffener strip and is heat sealed to itself, with the stiffener strip being intermediate at least two plies formed from the back wall. The bag mouth portion is located intermediate the stiffener strip and the closed bottom.

In one embodiment of the invention, the bag mouth portion is located immediately below the stiffener strip. The bag mouth portion may comprise a score line capable of being easily severed by manual manipulation or may comprise a slit extending across the front wall.

In one embodiment, the back wall of the bag extends past the front wall of the bag with the mouth portion comprising or defined by (a) the top edge of the front wall, and (b) the back wall of the bag.

The present invention can be applied to a type of plastic bag formed of single ply sheet material, and thereafter heat sealed or it may be formed of extruded tubular bag material.

A more detailed explanation of the invention is provided in the following description and claims, and is illustrated in the accompanying drawings.

BRIEF DESCRIPTION OF THE DRAWINGS

FIG. 1 is a view of a plastic sheet used to form a reclosable bag constructed in accordance with the principles of the present invention.

FIG. 2 is a cross-sectional view thereof, taken along the plane of the line 2—2 of FIG. 1;

FIG. 3 is a view of the plastic sheet of FIG. 1 after it has been folded to form a back wall and a front wall for the bag;

FIG. 4 is a cross-sectional view thereof, taken along the plane of the line 4—4 of FIG. 3;

FIG. 5 is a view of a plastic bag constructed in accordance with the principles of the present invention;

FIG. 6 is a cross-sectional view thereof, taken along the plane of the line 6—6 of FIG. 5;

FIG. 7 is a view of a stiffener strip used with a plastic bag constructed in accordance with the principles of the present invention;

FIG. 8 is a view of another form of stiffener strip;

FIG. 9 is a perspective view of a plastic bag constructed in accordance with the principles of the present invention;

FIG. 10 is a view of extruded tubular plastic material for use in constructing a bag according to a modified form of the invention;

FIG. 11 is a cross-sectional view thereof, taken along the plane of the line 11—11 of FIG. 10;

FIG. 12 is a view of the extruded plastic of FIG. 10 with the bottom thereof heat sealed;

FIG. 13 is a cross-sectional view thereof, taken along the plane of the line 13—13 of FIG. 12;

FIG. 14 is a view of a plastic bag formed of tubular extruded plastic material constructed in accordance with the principles of the present invention;

FIG. 15 is a cross-sectional view thereof, taken along the plane of the line 15—15 of FIG. 14; and FIG. 16 is an enlarged view of the top portion of FIG. 15.

DETAILED DESCRIPTION OF THE ILLUSTRATIVE EMBODIMENT

Referring to the embodiment of FIGS. 1–9, plastic bag 20 (FIG. 9) is shown therein formed of heat sealable film-type material, such as polyethylene. It is understood, however, that there is no limitation with respect to the type of heat sealable film-type plastic material which could be used for the body of the bag.

The bag 20 includes a stiffener strip 22 used in securing the closure of the bag as will be explained.

Referring now to FIGS. 1 and 2, plastic sheet material 24 is cut to a size adequate to form the bag. The bottom portion of sheet material 24 is folded over, as illustrated in FIGS. 3 and 4, to form a front wall 26 and a back wall 28, with the back wall 28 extending past the front wall 26 to form an upper portion 28*a*.

Stiffener strip 22, such as illustrated in FIG. 7, is positioned on portion 28*a* adjacent the end 32 of front wall 26. Stiffener strip 22 may be formed of any material capable of being bent manually and retaining the bent shape. Thus the stiffener strip 22 may be formed of metal, plastic, paper-coated wire, or any other suitable material. In FIG. 8, a paper-coated wire type stiffener strip 22' is illustrated.

After the stiffener strip 22 is positioned on the lower area of portion 28*a*, the upper area of portion 28*a* is folded over the stiffener strip and a heat seal is applied, thereby heat sealing the overfolded portion of portion 28*a* to itself, as illustrated in FIGS. 5 and 6.

Either prior to heat sealing the stiffener strip 22 to portion 28 in the manner stated above, at the same time as this heat sealing operation, or after this heat sealing operation is accomplished, the sides 36, 38 of the plastic bag are heat sealed in a conventional manner. It can be seen that the fold-over from FIGS. 1 and 2 to the FIGS. 3 and 4 illustration provides a closed bottom 40 and heat sealing the sides 36, 38 will form a receptacle, with end 32 of front wall 26 and back wall 28 defining the mouth of the receptacle. It can also be seen that the operation in which the stiffener strip 22 is fastened is extremely simple, in that it requires only an over-folding of portion 28 with heat sealing of the portion to itself, thereby providing a result in which the stiffener strip 22 is intermediate a first ply 40 and a second ply 42, with these two plies being formed from back wall portion 28*a*.

In using the completed bag, the article is placed into the mouth of the bag and the top portion 28*a* of the bag (including the stiffener strip) is rolled over several times and then the stiffener strip is bent in the manner illustrated in FIG. 9. This provides an extremely effective and secure closure which is reusable many times.

While in the preferred embodiment the bag is formed of sheet material, as illustrated in FIGS. 1–9, in another embodiment the bag may be formed of extruded tubular heat sealable film-type plastic material. This type of bag is illustrated in FIGS. 10–16.

Referring to FIGS. 10 and 11, the heat sealable film-type material 50 shown therein is the extruded type wherein ends 52 and 54 are cut from the extrudate. Thus sides 56 and 58 are closed and the item is extruded as a two-ply, closed-sided tube. For purposes of illustration, wall 60 will be considered the front wall and wall 62 will be considered the back wall of the item.

Now referring to FIGS. 12–13, the end 52 is heat sealed so as to form a closed bottom for the bag.

Stiffener strip 22 is positioned adjacent edge 54 on a front surface portion 66 of front wall 60. The top portion of front wall 60 and rear wall 62, adjacent stiffener strip 22, is folded over and then heat sealed to itself so as to enclose stiffener strip 22 intermediate four plies, the four plies comprising one ply of the front wall 60 and one ply of the back wall 62 behind stiffener strip 22 and one ply of the front wall 60 and one ply of the back wall 62 in front of stiffener strip 22, all as shown in FIGS. 15–16. Thereafter, a score line 70 is provided across front wall 60 underneath the overfold, to form the mouth of the bag. If desired, a slit could be provided instead of the score line.

In both embodiments, the stiffener may be tightly enclosed by the heat sealed back wall folded over itself, or the stiffener 22 may be loose or slidable within a pocket 80 formed by the heat seal. If secure fastening of the stiffener 22 is essential, the stiffener may define openings to permit the heat sealing through the stiffener 22. Further, the ends of the pocket 80 may be left unheat sealed, to permit the stiffener to slide out of or be inserted into the pocket. The stiffener 22 may be longer, or shorter, or the same length as pocket 80.

The above-mentioned bags are easy to manufacture using conventional poly-bag manufacturing techniques with minor modifications. Further, these bags are simple to operate and provide a secure closure system which can be reused many times.

Although two illustrative embodiments of the invention have been shown and described, it is to be understood that various modifications and substitutions may be made by those skilled in the art without departing from the novel spirit and scope of the present invention.

What is claimed is:

1. A plastic bag formed of heat sealable film-type material and including a front wall, a back wall and closed bottom and side edges, the improvement comprising, in combination: a stiffener strip capable of being bent manually and retaining the bent shape; the front wall and the back wall being folded over said stiffener strip and being heat sealed to the front wall whereby the stiffener strip is intermediate four plies formed from the front wall and the back wall; said heat sealed walls forming a pocket for said stiffener strip; and a bag mouth portion located intermediate said stiffener strip and said closed bottom, said bag mouth portion comprising a score line capable of being easily severed by manual manipulation.

* * * * *